US005275020A

United States Patent [19]

Scherzinger

[11] Patent Number: 5,275,020

[45] Date of Patent: Jan. 4, 1994

[54] CIRCULAR KNITTING MACHINE WITH A NEEDLE CYLINDER AND A DIAL

[75] Inventor: Werner Scherzinger, Bisingen, Fed. Rep. of Germany

[73] Assignee: SIPRA Patententwicklungs- und Beteiligungsgesellschaft mbH, Albstadt, Fed. Rep. of Germany

[21] Appl. No.: 932,299

[22] Filed: Aug. 19, 1992

[30] Foreign Application Priority Data

Aug. 27, 1991 [DE] Fed. Rep. of Germany ..... 4128372

[51] Int. Cl.[5] ..... D04B 9/06

[52] U.S. Cl. ..... 66/27; 66/28; 66/8; 66/54

[58] Field of Search ..... 66/27, 28, 8, 168, 13, 66/54, 55, 56

[56] References Cited

U.S. PATENT DOCUMENTS

| | | | |
|---|---|---|---|
| 3,757,538 | 9/1973 | Martinetz | 66/28 X |
| 4,030,318 | 6/1977 | Philip | 66/28 |
| 4,068,496 | 1/1978 | Bourgeois | 66/27 |
| 4,977,758 | 12/1990 | Muir | 66/27 |

FOREIGN PATENT DOCUMENTS

| | | |
|---|---|---|
| 1760124 | 11/1971 | Fed. Rep. of Germany . |
| 2212749 | 9/1973 | Fed. Rep. of Germany . |
| 2640112 | 3/1977 | Fed. Rep. of Germany . |
| 3232643 | 3/1984 | Fed. Rep. of Germany . |
| 3316382 | 11/1984 | Fed. Rep. of Germany . |

*Primary Examiner*—Clifford D. Crowder
*Assistant Examiner*—John J. Calvert
*Attorney, Agent, or Firm*—Michael J. Striker

[57] ABSTRACT

A circular knitting machine has a needle cylinder (7) and a dial (25) which define a comb distance (x). One of these two needle carriers and a respective cam (9, 27) are displaceably supported in a frame of the circular knitting machine. To prevent unwanted changes in the comb distance during temperature fluctuations, a compensating structural component part (30) is provided which is coupled with the displaceable needle carrier, usually the dial and the cam assigned to the latter and constructed and arranged in such a way that the unwanted changes in the comb distance are compensated for automatically by correspondingly dimensioned thermal expansion or upsetting of the compensating structural component part.

20 Claims, 3 Drawing Sheets

CIRCULAR KNITTING MACHINE WITH A NEEDLE CYLINDER AND A DIAL

BACKGROUND OF THE INVENTION

The invention is directed to a circular knitting machine having a frame in which a first carrier for knitting tools, a first cam assigned to the latter, a second carrier for knitting tools arranged above the first carrier, and a second cam assigned to the latter are mounted in such a way that changes in temperature result in an unwanted change in a comb distance measured in the direction of the machine axis and defined by the two carriers and one of the two carriers and the associated cam are supported so as to be displaceable in the direction of the machine axis.

In circular knitting machines of this type (e.g. DE-OS 17 60 124 and DE-OS 22 12 749) which have two needle carriers or beds and can be constructed as right/right circular knitting machines or interlock machines as well as double-cylinder machines, the reed or comb distance between the needle cylinder and the dial or rib disk, sometimes also called verge distance, and the strength or length of the stitches determined by it, vary depending on whether the machine is cold or warm, particularly in machines which generate high heat. Thus, knitted fabrics having varying stitch lengths are produced. This is generally the case in circular knitting machines which have a large number of knitting systems, are operated at high speed, have high gauges (number of knitting tools per inch) and/or develop a comparatively high friction between the knitting tools (needles, jacks, sinkers, etc.) and the respective cam parts.

The difference in comb distance results from the fact that the needle cylinder, which is generally supported in a frame by its lower end, increasingly expands axially upward when the machine is running warm or during other changes in temperature, whereas the dial or rib disk which is generally suspended at an upper frame part expands downward simultaneously. Because of this, or even as a result of only one of these two effects, the comb distance is increasingly reduced during warming and is smaller in warm running machines than in cold machines. Although these unwanted changes are comparatively small, e.g. in the order of magnitude of only several hundredths of a millimeter, they nevertheless have a significant influence on the operation of the circular knitting machine and on the quality of the knitted fabrics produced with it.

A result of this phenomenon is e.g. that a circular knitting machine whose comb distance has been adjusted in the warm state causes problems when started cold because the knitting tools consume more thread, the thread tension is correspondingly greater and the threads can even break. The machine must then be switched off, manually readjusted by an axial relative displacement of the dial and/or needle cylinder or by increasing the thread feed and then restarted. However, both of these adjustments are inadequate because they change the size of the stitch and the fabric quality and because the same adjustments would therefore have to be made in reverse after the machine has warmed up to maintain the stitch length and fabric quality actually desired in both a warm and a cold machine. It would therefore be ideal if the comb distance could be maintained constant independently of the respective machine temperature.

Similar problems result in circular knitting machines in which a sinker ring is securely connected with the upper end of the needle cylinder. In this case, however, the stitch size increases when the machine is running warm because the distance between the sinkers and the cylinder cam changes when the needle cylinder expands. Therefore, the known devices for preventing this problem (DE-OS 26 40 112, DE-OS 32 32 643 and DE-OS 33 16 382) can not easily be used to maintain a constant comb distance.

SUMMARY OF THE INVENTION

The present invention has the object of designing the circular knitting machine of the generic type described in the beginning in such a way that the unwanted changes in the comb distance occurring during fluctuations in temperature are substantially avoided.

A further object of this invention is to avoid unwanted changes in the comb distance by providing means which cause relative motion between the carriers and/or cams during fluctuations in temperature in such a way that changes of the comb distance resulting therefrom compensate for changes resulting from said fluctuations.

Yet another object of this invention is to automatically compensate unwanted changes in the comb distance resulting from fluctuations in temperature by providing the circular knitting machine with structural means having a characteristic which changes during fluctuations in temperature in substantially the same way as the comb-distance.

These and other objects of this invention are solved in that the knitting machine described above is provided with a structural component part which is coupled with the displaceably supported carrier and the cam assigned to the latter in such a way that thermal expansions or upsetting of the compensating structural component part in the direction of the machine axis result in corresponding displacements of the displaceable carrier and the associated cam, and in that the compensating structural component part is constructed and arranged in such a way that the unwanted changes in the comb distance are automatically compensated for by correspondingly dimensioned thermal expansion and upsetting of the compensating structural component part.

The invention provides the advantage that one of the two carriers and the respective cam can be automatically displaced relative to the other carrier or bed and its cam during a change in the machine temperature in such a way that the unavoidable and unwanted changes in the comb distance are accordingly canceled or balanced out so that the comb distance as a whole remains substantially constant.

Other advantageous features of the invention result from the subclaims.

The invention is explained in more detail in the following in connection with the attached drawing with reference to an embodiment example.

DESCRIPTION OF THE PREFERRED EMBODIMENTS

Figure 1:
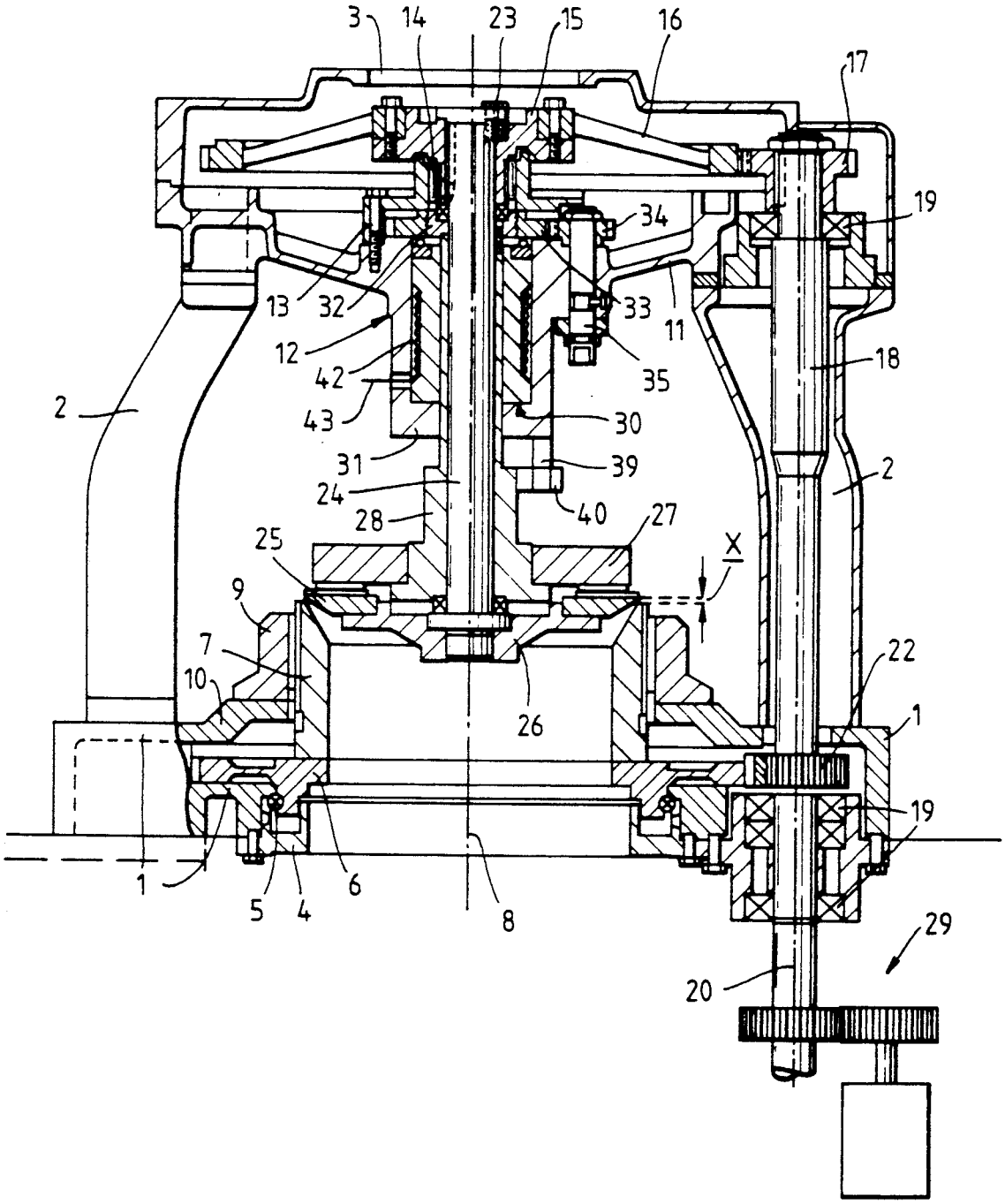
FIG. 1 shows an axial section through a circular knitting machine according to the invention.

Only the parts of a circular knitting machine required for an understanding of the invention are shown in the drawing. The rest of the parts of a circular knitting machine are known to the person skilled in the art and therefore need not be discussed further.

The circular knitting machine contains a frame having a lower, stationary supporting ring 1 and substantially vertical supporting columns 2 which are fastened at the latter and connected with one another at their top ends by a cover 3. An annular-flange body 4 is connected with the underside of the lower supporting ring 1 and together with the lower supporting ring 1 forms the bearing surfaces for a bearing 5 which is preferably constructed as a wire race ball bearing. A cylinder drive gear 6 is rotatably supported in the lower supporting ring 1 by means of this bearing 5. The flange body 4 preferably has means for preventing twisting in the region of the bearing 5 when the supporting ring 1 and the drive gear 6 expand or contract in various manners due to changes in temperature during the operation of the circular knitting machine.

A lower part, preferably the underside of a first knitting tool carrier in the form of a needle cylinder 7, is fastened on the drive gear 6 and is outfitted in a known manner with knitting tools, particularly knitting needles, not shown, and can rotate around a central machine axis 8. The needle cylinder 7 is enclosed by a stationary cylinder cam 9 provided with locking parts, not shown in more detail, which act on the feet of the knitting tools and is mounted with a lower part, preferably its underside, on a cylinder lock carrier 10 fastened at the lower supporting ring 1.

In an upper part of the circular knitting machine the supporting columns 2 are connected by an upper supporting ring 11 carrying a bearing cup 12 which is coaxial relative to the machine axis 8. The lower annular flange of a bearing sleeve 13 which is likewise coaxial is fastened on the bearing cup 12. A bearing 14 which is preferably constructed as a roller bearing is fastened at the inner surface area of the bearing sleeve 13 and supports a hub 15 in a rotatable manner. The hub 15 is connected with a coaxial dial drive gear 16 or is produced so as to form one piece with the latter, which piece meshes with a drive pinion 17 in such a way that it can execute defined movements relative to it parallel to the machine axis 8 without disengaging at either side. The drive pinion 17 is fastened at the upper end of a drive shaft 18 which is rotatably supported in one of the supporting columns 2 by upper and lower bearings 19, which are preferably constructed as roller bearings, and is arranged with its axis 20 parallel to the machine axis 8. Another drive pinion 22 is fastened on a lower part of the drive shaft 18 and meshes with the cylinder drive gear 6 and drives the latter at the same speed as the drive pinion 17 drives the dial drive gear 16.

A dial shaft 24 arranged coaxially relative to the machine axis 8 is fastened at the hub 15 by screws 23 and is securely connected with a dial carrier 26 supporting a second carrier in the form of a dial or rib disk 25. The dial 25 is arranged coaxially relative to the machine axis 8 in a known manner similar to the needle cylinder 7 and is outfitted with knitting tools, particularly knitting needles, not shown, which, in contrast to those of the needle cylinder 7, are supported so as to be radially displaceable rather than axially displaceable.

A stationary rib cam 27 provided with cam parts, not shown in more detail, is arranged above the dial 25 and fastened at the lower end of a dial supporting pipe 28 enclosing the dial shaft 24. The dial or rib disk shaft 24 is arranged so as to be rotatable in the supporting pipe 28 so that the rib disk 25 can be rotated together with the needle cylinder 7 relative to the cams 9 and 27 when a drive 29 which sets the drive shaft 18 in rotation is switched on, the drive 29 being indicated only schematically.

A compensating structural component part 30 in the form of a sleeve is loosely placed on the supporting pipe 28 and is simultaneously arranged inside the bearing cup 12 and supported by its lower end on a collar 31 which is arranged at the lower end of the bearing cup 12 and extends radially inward to the supporting pipe 28.

A threaded ring 32 through which the dial or ring disk shaft 24 projects and which is fastened at the supporting pipe 28 is arranged in the space formed by the annular flange of the bearing sleeve 13 above the bearing cup 12. The threaded ring 32 is provided with an external thread which engages with the internal thread of an adjusting ring 33 which is likewise supported in this space and surrounds the threaded ring 32. The adjusting ring 33 is provided at its outer circumference with a toothing which meshes with a toothed wheel 34 fastened on an adjusting member 35 which is rotatably supported in the upper supporting ring 11. The rotational axis of the adjusting ring 33 extends parallel to the machine axis 8. The adjusting ring 33 and the toothed wheel 34 engage in a manner similar to the toothed wheels 16, 17 in such a way that the adjusting ring 33 together with the threaded ring 32 can execute defined movements parallel to the machine axis 8 without disengaging. Moreover, the threaded ring 32 is rotatably arranged on the rib disk shaft 24.

Figure 2:
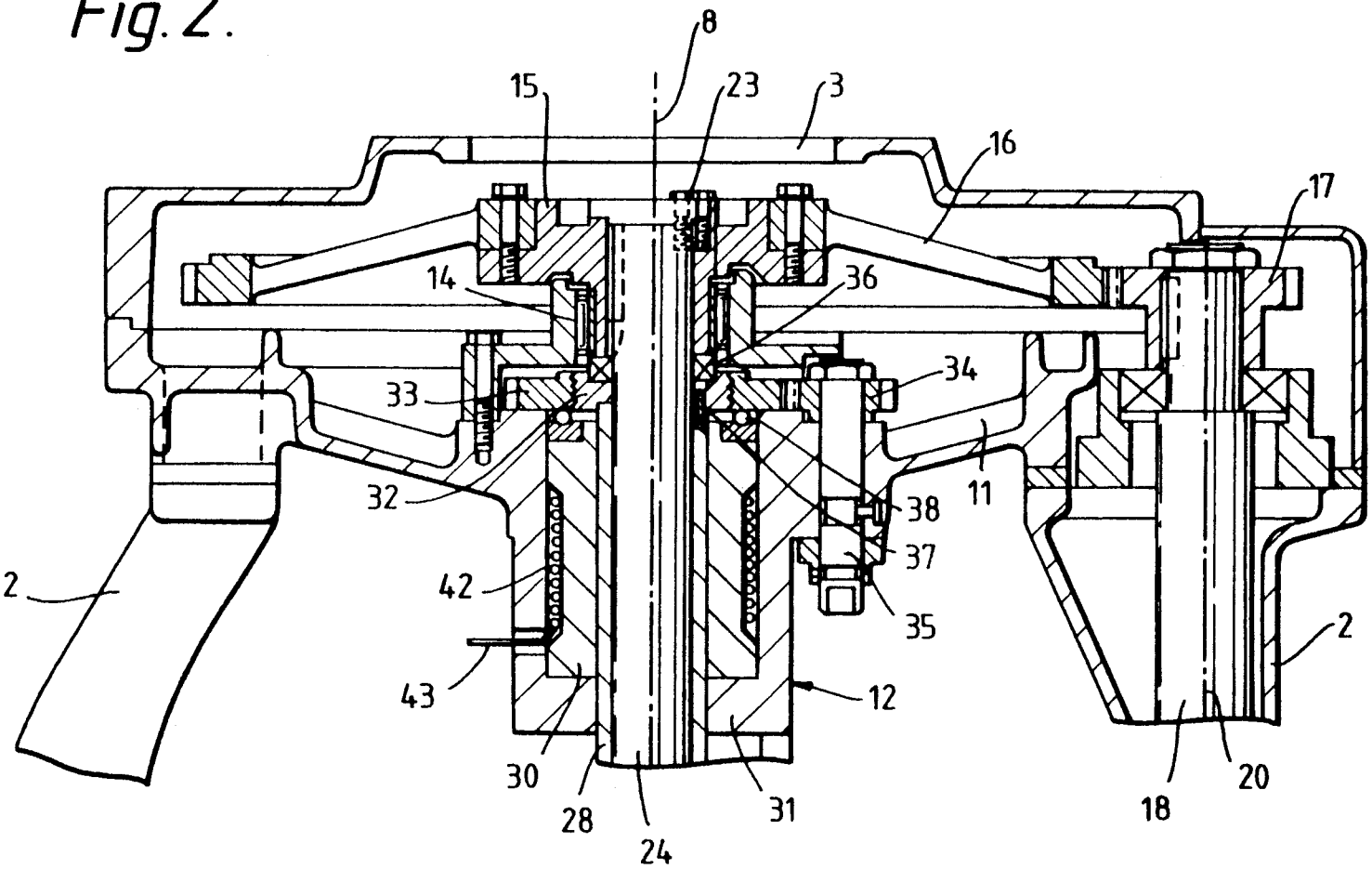
FIG. 2 shows a greatly enlarged part of FIG. 1.

As can be seen particularly from FIG. 2, the lower end of the hub 15 is supported on the upper end of the threaded ring 32 by a bearing 36 (FIG. 2) which is preferably constructed as a roller bearing, the lower end of the threaded ring 32 being fastened by fastening screws 37 at the upper end of the supporting pipe 28 projecting out of the bearing cup 12 and the compensating structural component part 30 in an upward direction. Moreover, the lower broad side of the adjusting ring 33 is supported on the upper end face of the compensating structural component part 30 by another bearing 38 which is preferably constructed as a ball bearing. Accordingly, the entire dial and dial cam arrangement is supported on the compensating structural component part 30 and the bearing cup 12 so as to be axially displaceable.

The threaded ring 32, the adjusting ring 33 and the adjusting member 35 form an adjusting device with which the comb distance x (FIG. 1) can be changed. The comb distance x is understood as the distance between the upper end face or the stitch knock-over edge of the needle cylinder 7 and the bases or bottoms of the grooves formed in the dial 25 which receive the knitting tools. In double-cylinder machines, the comb distance is given in a corresponding manner by the knock-over edge of the two needle cylinders. When the adjusting member 35 along with the toothed wheel 34 and the adjusting ring 33 is rotated in one or the other direction, this is linked with a lifting or lowering of the threaded ring 32. Since the latter is connected directly with the supporting pipe 28 on one side and acts via the bearing 36 on the hub 15 or the rib disk shaft 24 fastened to the latter on the other side, the supporting pipe 28 and the rib disk shaft 24 are also automatically lifted and lowered as the threaded ring 32 is lifted and lowered. This axial movement is possible because of the aforementioned ability of the drive gear 16 to execute defined displacements relative to the drive pinion 17 and of the adjusting ring 33 to execute defined displacements relative to the toothed wheel 34.

Finally, an arm 39 is connected with the lower end of the bearing cup. The arm 39 is securely connected with a radial arm 40 of the supporting pipe 28 and ensures that the dial cam 27 can not rotate along with the rib disk shaft 24. Alternatively, it is possible to provide an additional adjusting device between the two arms 39, 40 which makes it possible to adjust the rib lock 27 for simultaneous tension or after-tension in that the supporting pipe 28 and accordingly the rib lock 27 are rotated relative to the cylinder lock 9. During such a rotation the comb distance x would change because of the threaded ring 32, but this change could be canceled again by actuating the adjusting member 35 after the supporting pipe 28 has been fixed again. Of course, the effect of such a displacement carried out during the adjustment of the machine is so slight that it can also be ignored.

The compensating structural component part 30 serves substantially to compensate for unwanted and unavoidable changes in the comb distance x when the circular knitting machine is heated, i.e. at least to the extent that no substantial irregularities resulting from changes in the comb distance occur in the knitted fabrics and so that the automatic operation of the circular knitting machine is not impaired. The compensating structural component part 30 is constructed and arranged in such a way that when the circular knitting machine is heated it expands in the axial direction, i.e. parallel to the machine axis 8, to precisely the same extent by which the comb distance x is reduced and, when the circular knitting machine is cooled, contracts in the opposite direction to the extent that the comb distance x increases. Since the lower end of the compensating structural component part 30 is supported on the collar 31, it expands substantially upward in FIG. 1 when heated. Therefore, if the comb distance x is reduced e.g. by 0.02 mm when the circular knitting machine is heated to operating temperature proceeding from a cold start the compensating structural component part 30 is to be designed and arranged in such a way that its upper end face in FIG. 1 moves upward by the same amount in FIG. 1 due to temperature changes occurring during the operation of the machine and accordingly lifts the bearing 38 supported on it and, along with the latter, the adjusting ring 33, the threaded ring 32, the bearing 36, and the hub 15 and therefore also the rib disk shaft 24 and the supporting pipe 28 at which the rib disk 25 and the rib lock 27 are fastened. Accordingly, in the embodiment example the comb distance is increased in the opposite direction e.g. by said 0.02 mm so that it remains substantially constant overall.

The compensating structural component part 30 is preferably constructed in one of two ways which will be explained briefly in the following:

In the first variant, which is indicated in FIGS. 1 and 2 by crossed double hatching in the right-hand portion of the compensating structural component part 30, the latter is constantly exposed to a temperature which occurs automatically during the operation of the circular knitting machine. Therefore, the absolute amount by which the comb distance x changes must be determined by tests and/or calculations in each case when the circular knitting machine is heated from the normal ambient temperature to the actual operating temperature. Further, the amount by which the temperature changes where the compensating structural component part 30 is arranged when the circular knitting machine is brought from the cold state to the operating temperature must be determined by tests and/or calculations. Subsequently, the length which the compensating structural component part 30 would have to have depending on which material is selected can be calculated with the aid of the known thermal expansion coefficients and the known change in the comb distance x to be compensated, so that it is easily possible to manufacture a compensating structural component part 30 which can be used in each case. If the length of the compensating structural component part 30 is fixed for reasons relating to design, the only degree of freedom is the available material or its thermal expansion coefficient, i.e. a material must be found which undergoes the required linear expansion when there is a change in temperature. Tables of thermal expansion coefficients are available for selecting the material. The calculations and measurements to be made in each case can be carried out inexpensively by the person skilled in the art. Aluminum and various plastics, etc. are suitable materials, plastics being deemed to be the best ones up to now.

Figure 3:
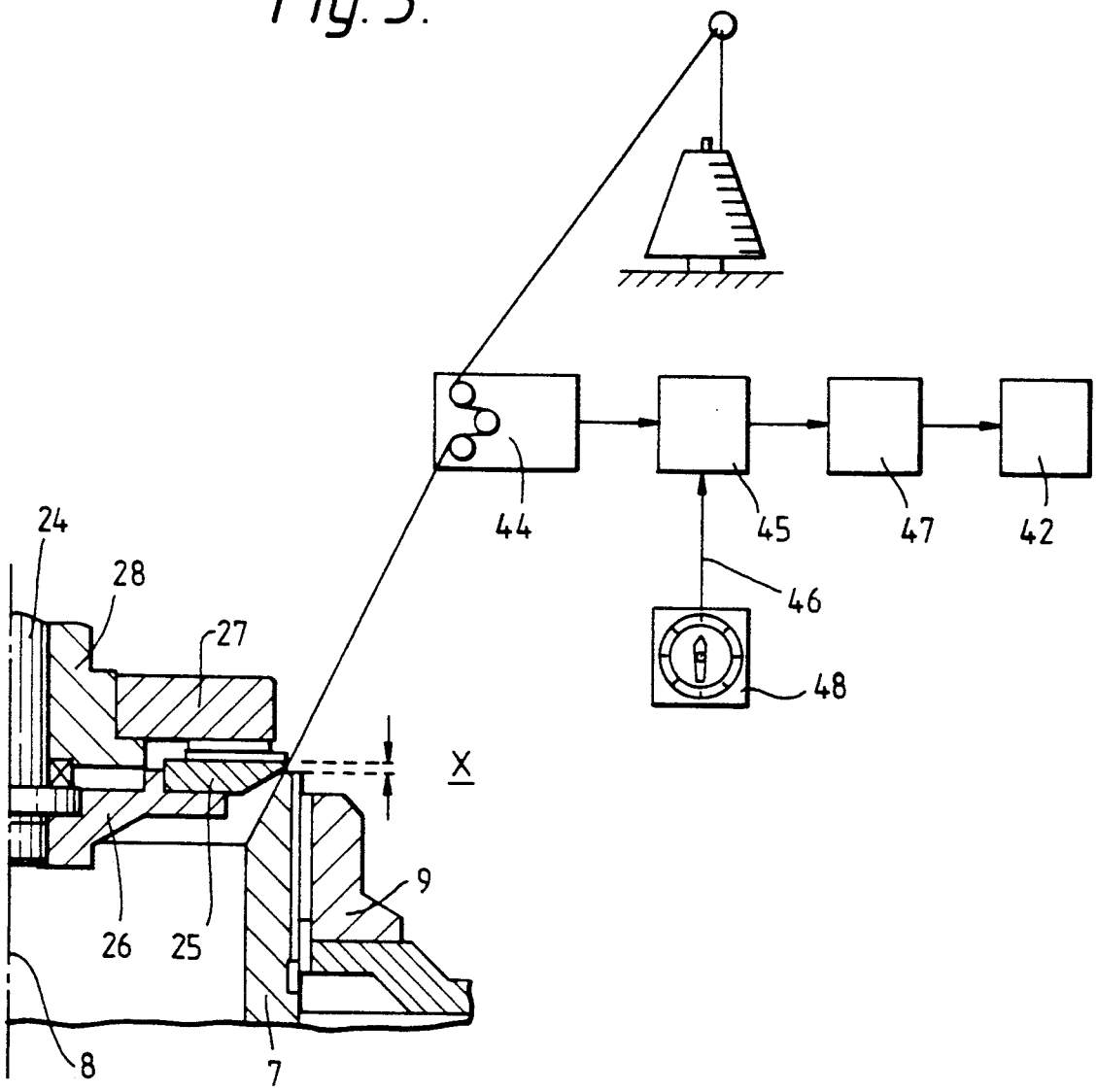
FIG. 3 shows a regulating circuit for the operation of a circular knitting machine according to FIGS. 1 and 2.

In the second preferred and presumably best variant which is indicated in FIGS. 1 and 2 by a simple, diagonal hatching in the left-hand portion of the compensating structural component part 30 the latter is heated additionally, regardless of the temperatures of the various parts of the circular knitting machine occurring in each case, and to the extent that the comb distance x remains substantially constant. For this purpose a heating device 42, e.g. an inserted heating spiral, whose connections 43 are connected with the regulating circuit shown in FIG. 3 is assigned to the compensating structural component part 30. This regulating circuit has a sensor 44 which measures either the comb distance x itself or a characteristic value for the latter, e.g. the thread tension, and feeds the measured actual value to a comparator 45 which compares this actual value with a preselected reference value supplied via a line 46. The differential value is fed to a regulator 47 which derives from it a control signal for a regulating device, in this case a current for the heating device 42, to prevent an otherwise occurring change in the comb distance x by more or less intensive heating of the compensating structural component part 30. The line 46 is preferably connected with a reference value transmitter 48 which can give off an adjustable reference value. This variant is therefore suitable particularly in cases where those changes in the length of the compensating structural component part 30 occurring during normal operation of the machine are not sufficient to compensate entirely or substantially for the changes in the comb distance.

Although distance sensors which are known per se, e.g. those working inductively or with eddy current, could be used for directly determining the comb distance, the thread tension is used as a characteristic measurement value for the comb distance x in an embodiment being held for the best one up to now since it immediately follows possible changes of the comb distance and can be determined in an extremely accurate manner. A particularly preferred embodiment form of a measurement value transmitter 44 for the thread tension is known from DE-PS 38 24 034. The desired comb distance can also be adjusted in the cold state of the circular knitting machine in this case. When the circular knitting machine is started, the heating device 42 is automatically switched on and off in such a way and the compensating structural component part 30 is heated to a greater or lesser extent in such a way that its thermal expansion brought about by this substantially compensates for the reduction in the comb distance effected by the heating of the circular knitting machine to operating temperature.

The invention is not limited to the described embodiment examples which can be modified in a simple manner. Alternatively, an additional sleeve could be provided between the compensating structural component part 30 and the bearing cup 12, which sleeve has a collar at the upper end which substantially corresponds to the collar 31 and extends inward to the supporting pipe 28 and engages over the compensating structural component part 30, and the bearing 38 could be supported on this collar. It is also possible to design the described compensating device in such a way that parts other than the machine parts described with reference to the embodiment example are heated. E.g. the supporting columns 2 can be taken into consideration in this respect, in which case the position of the entire dial and dial cam arrangement could be controlled by lifting or lowering the bearing cup 12, including the parts supported on it, in such a way that the comb distance remains substantially constant. It is also conceivable to divide the supporting columns 2 and connect them with one another by intermediately arranged compensating structural component parts having selected expansion coefficients. Further, the compensating structural component part 30 need not be realized in the shape of a sleeve. For example, it would be possible to arrange individual rods having corresponding thermal characteristics at the collar of the bearing cup 12 so as to be distributed at uniform intervals along the machine axis and arranged parallel to the latter. Further, the invention can also be applied in an analogous manner to circular knitting machines with stationary needle cylinders and dials and with circumferentially rotating cylinder and dial cams. In this case, the drive pinion 17 could be connected with a drive gear fastened on the supporting pipe 28 and the dial shaft kept stationary. Moreover, a collar arranged at the supporting pipe 28 could be supported by a bearing so as to be rotatable on the threaded ring 32 and a collar arranged at the rib disk shaft 24 could be rotatably supported by another bearing on the collar of the supporting pipe so that the compensating structural component part 30 in turn acts on the entire dial and dial cam construction via the adjusting ring 33 and the threaded ring 32. Finally, it would be conceivable in this respect to entirely omit the adjusting device. In this case if the supporting pipe is kept stationary a collar which is arranged on the latter could be supported directly on the upper end of the compensating structural component part 30, whereas a bearing would have to be provided between the two if the supporting pipe were rotatably supported. Moreover, the bearing 36 would have to be arranged between the supporting pipe and the rib disk shaft or the hub 15 in both cases.

Finally, the invention is not limited only to the arrangement in which the carrier formed by the dial is lifted and lowered in an aimed for manner by a compensating structural component part. Rather, unwanted changes in the comb distance could also be compensated for in that the carrier formed by the needle cylinder 9 and the assigned cylinder cam are displaceably supported in the frame and the compensating structural component part acts only on the latter. It would also be possible to support both carriers and the respective cams so as to be displaceable and to provide a compensating structural component part for each carrier and the respective cam insofar as the thermal expansion and upsetting of these two compensating structural component parts in the direction of the machine axis result in displacements of the carriers and cams such that the unwanted changes in the comb distance are automatically compensated for.

I claim:

1. Circular knitting machine comprising: a machine axis (8), a frame, a first carrier (&) for knitting tools, a first cam (9) assigned to the first carrier, a second carrier (25) for knitting tools arranged above the first carrier, and a second cam (27) assigned to the second carrier, at least one of said carriers and the cam assigned thereto being displaceably supported in the direction of the machine axis and both carriers defining a comb distance (x) measured in the direction of the machine axis, said comb distance being subjected to unwanted changes caused by thermal expansions or upsettings during operation of the machine, and further comprising a compensating structural component part (30) being coupled with the displaceable carrier (25) and the cam (27) assigned to the displaceable carrier (25), said compensating structural component part being subject to thermal expansions or upsettings during operation of the machine in the direction of the machine axis (8) and causing corresponding displacements of the displaceable carrier (25), and the cam (27) associated to the displaceable carrier (25), the displacement caused by said compensating structural component part (3) automatically substantially compensating said unwanted changes in the comb distance (x).

2. Circular knitting machine according to claim 1, wherein the compensating structural component part (30) during changes in temperature is expanded or shortened automatically and in the direction of the machine axis (8) by an amount corresponding to the unwanted changes in the comb distances (x) by additional warming or cooling.

3. Circular knitting machine according to claim 1, wherein a heating device is assigned to the compensating structural component part (30) and the unwanted changes in the comb distance (x) are compensated for by the heating device (42) by additional warming or cooling of the compensating structural component part (30).

4. Circular knitting machine according to claim 1, wherein the first carrier (7) and a cam (9) assigned to the first carrier (7) are supported by lower portions in the frame, while the second carrier (25) and a cam (27) assigned to the second carrier (25) are suspended at an upper frame part.

5. Circular knitting machine according to claim 1, wherein the first carrier (7) and the second carrier (25) are rotatably supported in the frame.

6. Circular knitting machine according to claim 1, wherein the second carrier (25) and the cam (27) assigned to the second carrier (25) are displaceably supported in the frame.

7. Circular knitting machine according to claim 6, wherein the cam (27) assigned to the second carrier (25)

is fastened at a supporting pipe (28) and the second carrier (25) is fastened at a shaft (24) arranged in the supporting pipe (28).

8. Circular knitting machine according to claim 7, wherein the compensating structural component part (3) has a sleeve which sits loosely on the supporting pipe (28) said sleeve being supported by a lower portion in the frame and having an upper part supporting the supporting pipe (28) and the shaft (24).

9. Circular knitting machine according to claim 8, wherein the sleeve is supported in a bearing cup (12), said bearing cup being coaxial with the machine axis (8) and fastened in the frame.

10. Circular knitting machine according to claim 7, wherein the upper end of the shaft (24) is fastened in a hub (15) of a drive gear (16).

11. Circular knitting machine according to claim 7, wherein an adjusting device is provided for the comb distance (x).

12. Circular knitting machine according to claim 11, wherein the adjusting device has a threaded ring (32) with an external thread, said ring being penetrated by the shaft (24) and fastened at the supporting pipe (28) and an adjusting ring (33) being screwed onto the threaded ring (32) and provided with a corresponding internal thread.

13. Circular knitting machine according to claim 8, wherein the shaft (24) and the supporting pipe (28) are supported on the compensating structural component part (30) by at least one bearing (36,38).

14. Circular knitting machine according to claim 13, wherein the shaft (24) is supported on the threaded ring (32) by a first bearing (36) and the adjusting ring (33) is supported on the compensating structural component part (3) by a second bearing (38).

15. Circular knitting machine according to claim 14, wherein the first bearing (36) is arranged between the threaded ring (32) and the hub (15).

16. Circular knitting machine according to claim 3, wherein the heating device (42) has a heating coil inserted in the compensating structural component part (30).

17. Circular knitting machine according to claim 3, wherein the heating device (42) is connected in a regulating circuit containing a sensor (44), said sensor generating a characteristic signal for the comb distance (x).

18. Circular knitting machine according to claim 17, wherein the sensor (44) is a thread tension sensor.

19. Circular knitting machine according to claim 1, wherein the first carrier (7) is a needle cylinder.

20. Circular knitting machine according to claim 1, wherein the second carrier (25) is a dial.

* * * * *